US010170062B2

(12) United States Patent
Chen et al.

(10) Patent No.: US 10,170,062 B2
(45) Date of Patent: Jan. 1, 2019

(54) DISPLAY PANEL, DISPLAY AND A METHOD OF RAISING A PURE COLOR IMAGE BRIGHTNESS OF FOUR PRIMARY COLORS

(71) Applicant: Wuhan China Star Optoelectronics Technology Co., Ltd., Wuhan, Hubei (CN)

(72) Inventors: Wei Chen, Guangdong (CN); Chun-hung Huang, Guangdong (CN); Xiaoping Tan, Guangdong (CN); Tingting Zhang, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 381 days.

(21) Appl. No.: 14/916,999

(22) PCT Filed: Jan. 14, 2016

(86) PCT No.: PCT/CN2016/070914

§ 371 (c)(1),
(2) Date: Mar. 5, 2016

(87) PCT Pub. No.: WO2017/107266

PCT Pub. Date: Jun. 29, 2017

(65) Prior Publication Data

US 2018/0061334 A1 Mar. 1, 2018

(30) Foreign Application Priority Data

Dec. 23, 2015 (CN) ..... 2015 1 0979465

(51) Int. Cl.
*G09G 3/36* (2006.01)
*G09G 5/10* (2006.01)

(52) U.S. Cl.
CPC ..... *G09G 3/3607* (2013.01); *G09G 5/10* (2013.01); *G09G 2300/0452* (2013.01); *G09G 2320/0626* (2013.01); *G09G 2320/0673* (2013.01)

(58) Field of Classification Search
CPC ..... G09G 3/3607; G09G 5/10; G09G 2320/0673; G09G 2300/0452; G09G 2320/0626
See application file for complete search history.

(56) References Cited

U.S. PATENT DOCUMENTS

2009/0207182 A1 8/2009 Takada
2010/0091030 A1 4/2010 Park
(Continued)

FOREIGN PATENT DOCUMENTS

CN 101510022 A 8/2009
CN 102034446 A 4/2011
(Continued)

*Primary Examiner* — Abhishek Sarma
(74) *Attorney, Agent, or Firm* — Andrew C. Cheng

(57) ABSTRACT

The present invention provides a method of raising a pure color image brightness of four primary colors, employed to raise a display brightness of a four primary colors display panel as showing a pure color image, and the method comprises: deactivating a W pixel of the display panel and changing gamma values of a R pixel, a G pixel, a B pixel from a first predetermined values to a second predetermined value; and activating the W pixel, and adjusting a gray scale image of the entire display panel to be a first predetermined value. The present invention further provides a display panel and a display. The display panel, the display and the method of the present invention can raise the display brightness of the display panel as showing the pure color image.

9 Claims, 3 Drawing Sheets

(56) References Cited

U.S. PATENT DOCUMENTS

| | | | | |
|---|---|---|---|---|
| 2011/0084990 | A1* | 4/2011 | An | G09G 3/3648 345/690 |
| 2011/0205259 | A1* | 8/2011 | Hagood, IV | G09G 3/2003 345/690 |
| 2012/0001947 | A1 | 1/2012 | Chu-Ke | |
| 2014/0085170 | A1 | 3/2014 | Park et al. | |
| 2015/0091950 | A1 | 4/2015 | Park | |

FOREIGN PATENT DOCUMENTS

| | | | |
|---|---|---|---|
| CN | 103915059 | A | 7/2014 |
| CN | 104517559 | A | 4/2015 |
| CN | 104732938 | A | 6/2015 |

* cited by examiner

| Item | FHD(RGB) | FHD(RGBW) | QHD(RGB) | QHD(RGBW) |
|---|---|---|---|---|
| Cell aperture ratio | 39.30% | 48.83% | 25.07% | 34.50% |
| Cell transmittance | 3.68% | 7.00% | 2.35% | 4.90% |
| pure color transmittance | 13.10% | 9.83% | 8.40% | 6.30% |

DISPLAY PANEL, DISPLAY AND A METHOD OF RAISING A PURE COLOR IMAGE BRIGHTNESS OF FOUR PRIMARY COLORS

CROSS REFERENCE

This application claims the priority of Chinese Patent Application No. 201510979465.0, entitled "Display panel, display and a method of raising a pure color image brightness of four primary colors", filed on Dec. 23, 2015, the disclosure of which is incorporated herein by reference in its entirety.

FIELD OF THE INVENTION

The present invention relates to a method of display image process, and more particularly relates to a method of raising a pure color image brightness of four primary colors, a display panel and a display having the display panel.

BACKGROUND OF THE INVENTION

With the higher energy saving and environment protecting consciousnesses and the lighter and thinner development trench of the mobile phone, the requirements of energy saving, the lighter and thinner volume of the battery, the battery life become more and more important to the phone makers and the end consumers. The energy saving is a great sell point of the mobile phone. The transmittance of the RGBW display panel (the display panel based on the RGBW four primary colors display technology) has significant promotion than the RGB display panel (the display panel based on the RGB three primary colors display technology) with the addition of the white pixels. With the sub pixel sharing algorithm, under the premise of not changing the resolution, the pixel amount of the panel is decreased ⅓ to eliminate the production yield risk of super high resolution, and meanwhile, the backlight power consumption is reduced 40% for raising the effect of high picture contrast.

As shown in FIG. 1, in the FHD (Full High Definition) mode, the aperture ratio of the cell of the RGBW display panel is 1.24 times of the aperture ratio of the RGB display panel. In QHD (Quarter High Definition, ¼HD) mode, the aperture ratio of the cell of the RGBW display panel is 1.37 times of the aperture ratio of the RGB display panel. Meanwhile, the transmittance of the white pixel is close to 1. Therefore, the transmittance of four primary colors panel is 1.9-2.0 times of that of the traditional panel. However, the W pixel in conducted into the RGBW display panel, the aperture ratios of the R, G, B becomes 75% of the traditional RGB panel. Accordingly, the brightness of the RGBW display panel as showing the pure color, R, G, or B is not as high as the brightness of the traditional RGB panel.

SUMMARY OF THE INVENTION

The present invention provides a display panel, a display and a method of raising a pure color image brightness of four primary colors to raise the brightness of the four primary colors as showing the pure color image.

The embodiment of the present invention discloses a display panel, and the display panel comprises a plurality of pixel units aligned in array, and each pixel unit comprises a R pixel, a G pixel, a B pixel and a W pixel, wherein a gamma value of the W pixel of the display panel is set to be a first predetermined value, and gamma values of the R pixel, the G pixel, the B pixel of the display panel are set to be a second predetermined value smaller than the first predetermined value.

In one embodiment, a gamma value of an entire gray scale image of the display panel is set to be the first predetermined value.

In one embodiment, the first predetermined value is 2.2, and the second predetermined value is 1.8.

In one embodiment, the display panel is implemented with process steps of: changing the gamma values of the R pixel, the G pixel, the B pixel from the first predetermined values to the second predetermined value as deactivating the W pixel; and adjusting a gray scale image of the entire display panel to be the first predetermined value as activating the W pixel.

In one embodiment, the display panel further comprises a controller and a plurality of pixel electrodes, and each pixel electrode corresponds to any one of the R pixel, the G pixel, the B pixel, W pixel, and the controller changes the gamma values of the R pixel, the G pixel, the B pixel from the first predetermined values to the second predetermined value by adjusting parameters corresponding to the pixel electrodes of the R pixel, the G pixel, the B pixel.

The embodiment of the present invention discloses a display, and the display comprises a display panel. The display panel comprises a plurality of pixel units aligned in array, and each pixel unit comprises a R pixel, a G pixel, a B pixel and a W pixel, wherein a gamma value of the W pixel of the display panel is set to be a first predetermined value, and gamma values of the R pixel, the G pixel, the B pixel of the display panel are set to be a second predetermined value smaller than the first predetermined value.

In one embodiment, a gamma value of an entire gray scale image of the display panel is set to be the first predetermined value.

In one embodiment, the first predetermined value is 2.2, and the second predetermined value is 1.8.

In one embodiment, the display panel is implemented with process steps of: changing the gamma values of the R pixel, the G pixel, the B pixel from the first predetermined values to the second predetermined value as deactivating the W pixel; and adjusting a gray scale image of the entire display panel to be the first predetermined value as activating the W pixel.

In one embodiment, the display panel further comprises a controller and a plurality of pixel electrodes, and each pixel electrode corresponds to any one of the R pixel, the G pixel, the B pixel, W pixel, and the controller changes the gamma values of the R pixel, the G pixel, the B pixel from the first predetermined values to the second predetermined value by adjusting parameters corresponding to the pixel electrodes of the R pixel, the G pixel, the B pixel.

The embodiment of the present invention provides a method of raising a pure color image brightness of four primary colors, employed to raise a display brightness of a four primary colors display panel as showing a pure color image, and the method comprises: deactivating a W pixel of the display panel and changing gamma values of a R pixel, a G pixel, a B pixel from a first predetermined values to a second predetermined value.

In one embodiment, the method further comprises a step of: activating the W pixel, and adjusting a gray scale image of the entire display panel to be a first predetermined value.

In one embodiment, the step of deactivating the W pixel of the display panel and changing the gamma values of the R pixel, the G pixel, the B pixel from the first predetermined values to the second predetermined value comprises: deactivating the W pixel of the display panel; simultaneously changing the gamma values of the R pixel, the G pixel, the B pixel from the first predetermined values to the second predetermined value or sequentially changing the gamma values of the R pixel, the G pixel, the B pixel from the first predetermined values to the second predetermined value.

In one embodiment, the first predetermined value is 2.2, and the second predetermined value is 1.8.

In comparison with prior art, the embodiment of the present invention has benefits below: capable of raising the display brightness of the display panel as showing the pure color image.

BRIEF DESCRIPTION OF THE DRAWINGS

In order to more clearly illustrate the embodiments of the present invention, the following figures will be described in the embodiments are briefly introduced. It is obvious that the drawings are only some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Figures 1, 2:
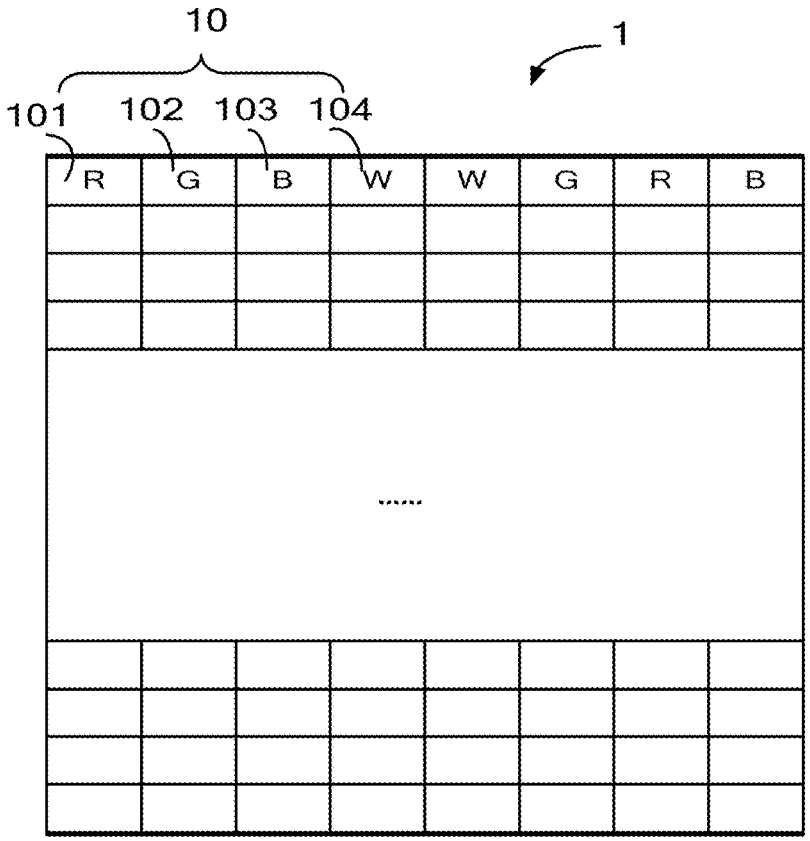
FIG. 1 is a comparison table of related performance parameters of the four primary colors display panel relative to the three primary colors display panel according to prior art.
FIG. 2 is a pixel array diagram of the display panel in one embodiment of the present invention.

Please refer to FIG. 2, which is a pixel array diagram of the display panel 1 in one embodiment of the present invention. In this embodiment, the display panel 1 is a four primary colors display panel. The display panel 1 comprises a plurality of a plurality of pixel units 10 aligned in array, and each pixel unit 10 comprises four pixels, a R (Red) pixel 101, a G (Green) pixel 102, a B (Blue) pixel 103 and a W (White) pixel 104. A gamma value of the W pixel 104 of the display panel 1 is set to be a first predetermined value, and gamma values of the R pixel 101, the G pixel 102, the B pixel 103 of the display panel 1 are set to be a second predetermined value smaller than the first predetermined value. Accordingly, the brightness values of the gamma middle gray scales of the R pixel 101, the G pixel 102, the B pixel 103 of the display panel 1 are raised, and the brightness values of the W pixel 104 are unchanged to raise the contribution of the R, G, B pixels to the brightness, and to raise the brightness of the display panel 1 as showing the pure color image.

In this embodiment, a gamma value of an entire gray scale image of the display panel 1 is further set to be the first predetermined value. Accordingly, the gamma curve of the entire gray scale image of the display panel 1 fits the first predetermined value and maintains the better whole display result of the display panel 1.

In this embodiment, the first predetermined value is 2.2, and the second predetermined value is 1.8. Apparently, the first predetermined value and the second predetermined value can be other proper values as long as the demands that the first predetermined value is the best whole display result value of the display panel 1, and the second predetermined value is lower than the first predetermined value are satisfied.

Figure 3:
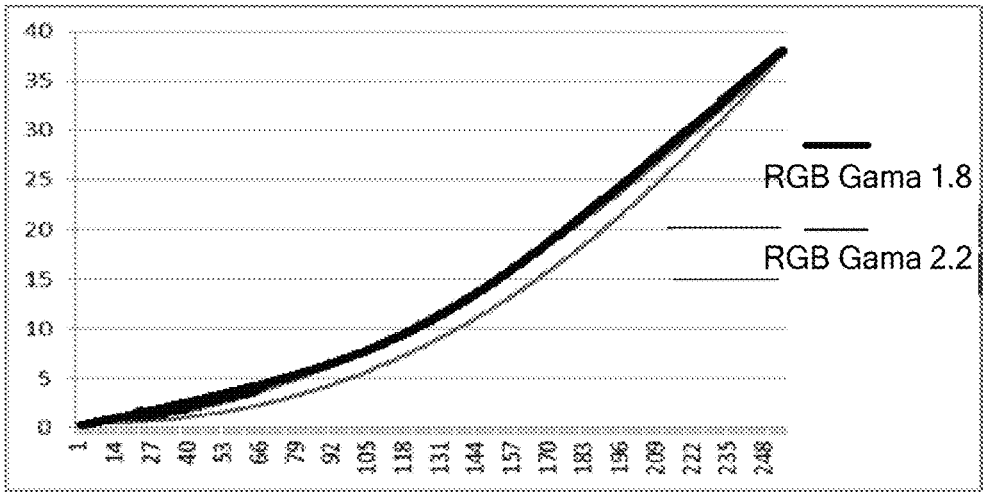
FIG. 3 is a gamma curve diagram corresponded with that the RGB pixel are at the various gamma values in the display panel in one embodiment of the present invention.

Please refer to FIG. 3. As shown in FIG. 3, after the gamma values of the R, G, B pixels are changed from 2.2 to 1.8, the brightness values of the gamma middle gray scales are raised to raise the contribution of the R, G, B pixels to the brightness, and to raise the brightness of the display panel 1 as showing the pure color image.

In this embodiment, the display panel 1, which is a regular four primary colors display panel, is implemented with process steps of: 1. changing the gamma values of the R pixel 101, the G pixel 102, the B pixel 103 from the first predetermined values to the second predetermined value as deactivating the W pixel 104; and 2. adjusting a gray scale image of the entire display panel 1 to be the first predetermined value as activating the W pixels 104. As the gamma values of the R pixel 101, the G pixel 102, the B pixel 103 are changed from the first predetermined values to the second predetermined value, the W pixel 104 is deactivated. Therefore, the gamma value of the W pixel 104 is remains to be the first predetermined value and unchanged.

Deactivating the W pixel 104 means deactivating all the W pixels 104 on the display panel 1, and changing the gamma values of the R pixel 101, the G pixel 102, the B pixel 103 from the first predetermined values to the second predetermined value means changing the gamma values of all the R pixels 101, the G pixels 102, the B pixels 103 on the display panel 1 from the first predetermined values to the second predetermined value.

In one embodiment, the step of changing the gamma values of the R pixel 101, the G pixel 102, the B pixel 103 from the first predetermined values to the second predetermined value as deactivating the W pixel 104 is simultaneously changing the gamma values of the R pixel 101, the G pixel 102, the B pixel 103 from the first predetermined values to the second predetermined value as deactivating the W pixel 104. In another embodiment, the step of changing the gamma values of the R pixel 101, the G pixel 102, the B pixel 103 from the first predetermined values to the second predetermined value as deactivating the W pixel 104 is sequentially changing the gamma values of the R pixel 101, the G pixel 102, the B pixel 103 from the first predetermined values to the second predetermined value as deactivating the W pixel 104.

Figure 4:
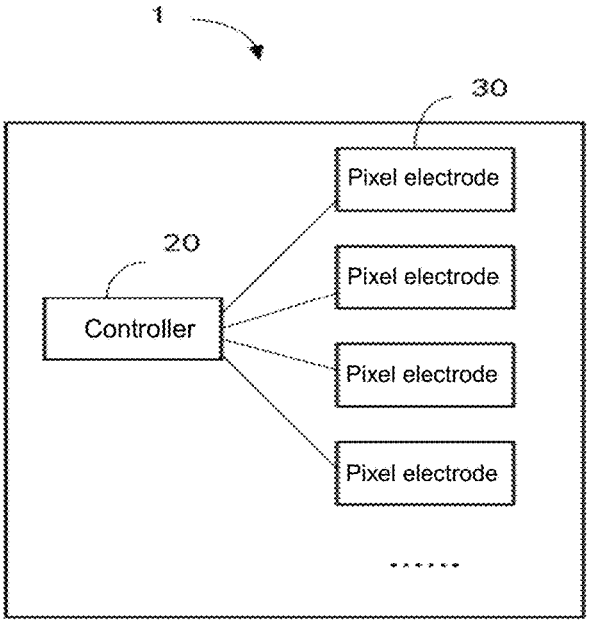
FIG. 4 is a module structure diagram of partial elements of the display panel in one embodiment of the present invention.

Please refer to FIG. 4, together, which is a diagram of partial elements of the display panel 1. The display panel 1 further comprises a controller 20 and a plurality of pixel electrodes 30, and each pixel electrode 30 corresponds to any one of the R pixel 101, the G pixel 102, the B pixel 103, W pixel 104. The controller 20 adjusts and changes the gamma values of the R pixel 101, the G pixel 102, the B pixel 103 from the first predetermined value to the second predetermined value by adjusting parameters corresponding to the pixel electrodes 30 of the R pixel 101, the G pixel 102, the B pixel 103, the W pixel 104.

The parameters of the adjusted pixel electrodes 30 can be the driving voltage. The controller 20 can change and adjust the gamma values of the R pixel 101, the G pixel 102, the B pixel 103 from the first predetermined value to the second predetermined value by adjusting the driving voltage corresponding to the pixel electrodes 30 of the R pixel 101, the G pixel 102, the B pixel 103.

Deactivating the W pixel 104 means that the controller 20 controls to stop applying scan voltage to the W pixel 104. Activating the W pixel 104 means that the controller 20 controls to apply scan voltage to the W pixel 104.

In this embodiment, the display panel 1 is a liquid crystal display panel, and the each of the R pixel 101, the G pixel 102, the B pixel 103, the W pixel 104 comprises a liquid crystal molecule and a filter having a corresponding color. In other embodiments, the display panel 1 can be the plasma display panel, an e-paper display panel.

Figure 5:
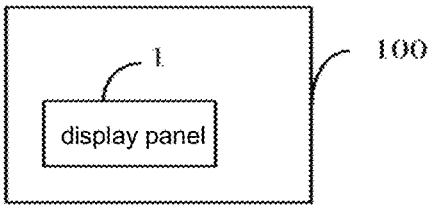
FIG. 5 is a module structure diagram of the display in one embodiment of the present invention.

Please refer to FIG. 5, which is a module diagram of a display 100. The display 100 comprises the display panel 1. The display 100 can be a computer screen, a cellular phone, a television and et cetera. The display 100 utilizes the display panel 1. Thus, the display 100 can raise the display brightness as showing the pure color image.

The display 100 also comprises other elements, such the process chip, the audio chip. Because these are not irrelevant with the improvement of the present invention, no description is introduced here.

Figure 6:
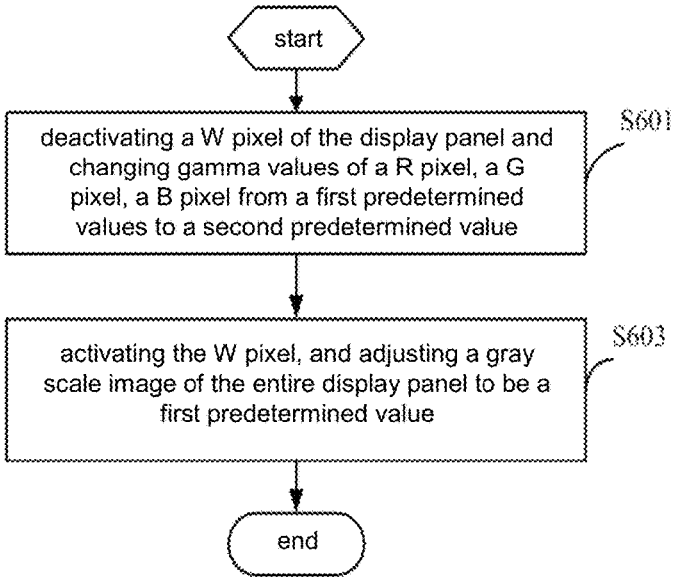
FIG. 6 is a flow chart of a method of raising a pure color image brightness of four primary colors in one embodiment of the present invention.

Please refer to FIG. 6, which is a flow chart of a method of raising a pure color image brightness of four primary colors in one embodiment of the present invention. The method is employed to raise the display brightness of the display panel 1 as showing the pure color image, and comprises step of:

deactivating a W pixel 104 of the display panel 1 and changing gamma values of a R pixel 101, a G pixel 102, a B pixel 103 of the display panel 1 from a first predetermined values to a second predetermined value (S601). In one embodiment, this step is simultaneously changing the gamma values of the R pixel 101, the G pixel 102, the B pixel 103 from the first predetermined values to the second predetermined value. In another embodiment, this step is sequentially changing the gamma values of the R pixel 101, the G pixel 102, the B pixel 103 from the first predetermined values to the second predetermined value. In this embodiment, the first predetermined value is 2.2, and the second predetermined value is 1.8.

activating the W pixel 104, and adjusting a gray scale image of the entire display panel 1 to be a first predetermined value (S603).

Above are embodiments of the present invention, which does not limit the scope of the present invention. Any modifications, equivalent replacements or improvements within the spirit and principles of the embodiment described above should be covered by the protected scope of the invention.

What is claimed is:

1. A display panel, and the display panel comprises a plurality of pixel units aligned in array, and each pixel unit comprises a R pixel, a G pixel, a B pixel and a W pixel, wherein a gamma value of the W pixel of the display panel is set to be a first predetermined value, and gamma values of the R pixel, the G pixel, the B pixel of the display panel are set to be a second predetermined value smaller than the first predetermined value, wherein the display panel is implemented with process steps of: changing the gamma values of the R pixel, the G pixel, the B pixel from the first predetermined values to the second predetermined value as deactivating the W pixel; and adjusting a gray scale image of the entire display panel including the R pixel, the G pixel, the B pixel and W pixel to be the first predetermined value as activating the W pixel to raise brightness values of gamma middle gray scales of the R pixel, the G pixel and the B pixel to increase a contribution of the R pixel, the G pixel and the B pixel to a brightness of the display panel as showing a pure color image.

2. The display panel according to claim 1, wherein a gamma value of an entire gray scale image of the display panel is set to be the first predetermined value.

3. The display panel according to claim 2, wherein the first predetermined value is 2.2, and the second predetermined value is 1.8.

4. A display, comprising a display panel, wherein the display panel comprises a plurality of pixel units aligned in array, and each pixel unit comprises a R pixel, a G pixel, a B pixel and a W pixel, wherein a gamma value of the W pixel of the display panel is set to be a first predetermined value, and gamma values of the R pixel, the G pixel, the B pixel of the display panel are set to be a second predetermined value smaller than the first predetermined value, wherein the display panel is implemented with process steps of: changing the gamma values of the R pixel, the G pixel, the B pixel from the first predetermined values to the second predetermined value as deactivating the W pixel; and adjusting a gray scale image of the entire display panel including the R pixel, the G pixel, the B pixel and W pixel to be the first predetermined value as activating the W pixel to raise brightness values of gamma middle gray scales of the R pixel, the G pixel and the B pixel to increase a contribution of the R pixel, the G pixel and the B pixel to a brightness of the display panel as showing a pure color image.

5. The display according to claim 4, wherein a gamma value of an entire gray scale image of the display panel is set to be the first predetermined value.

6. The display according to claim 5, wherein the first predetermined value is 2.2, and the second predetermined value is 1.8.

7. A method of raising a pure color image brightness of four primary colors, employed to raise a display brightness of a four primary colors display panel as showing a pure color image, and the method comprises:

deactivating a W pixel of the display panel and changing gamma values of a R pixel, a G pixel, a B pixel from a first predetermined values to a second predetermined value;

activating the W pixel, and adjusting a gray scale image of the entire display panel including the R pixel, the G pixel, the B pixel and W pixel to be a first predetermined value to raise brightness values of gamma middle gray scales of the R pixel, the G pixel and the B pixel to increase a contribution of the R pixel, the G pixel and the B pixel to a brightness of the display panel as showing a pure color image.

8. The method according to claim 7, wherein the step of deactivating the W pixel of the display panel and changing the gamma values of the R pixel, the G pixel, the B pixel from the first predetermined values to the second predetermined value comprises:

deactivating the W pixel of the display panel;

simultaneously changing the gamma values of the R pixel, the G pixel, the B pixel from the first predetermined values to the second predetermined value or sequentially changing the gamma values of the R pixel, the G pixel, the B pixel from the first predetermined values to the second predetermined value.

9. The method according to claim 7, wherein the first predetermined value is 2.2, and the second predetermined value is 1.8.

* * * * *